US005692714A

United States Patent [19]

Morrison

[11] Patent Number: 5,692,714

[45] Date of Patent: Dec. 2, 1997

[54] AUTOMATIC SELF-ERECTING DISPLAY STAND

[75] Inventor: Mark D. Morrison, Fenton, Mo.

[73] Assignee: Jefferson Smurfit Corporation, Clayton, Mo.

[21] Appl. No.: 651,934

[22] Filed: May 21, 1996

[51] Int. Cl.[6] ..... A45D 19/04

[52] U.S. Cl. ..... 248/174; 211/132; 211/149; 248/459

[58] Field of Search ..... 248/174, 459; 211/72, 132, 149, 195; 206/44 R, 45.2, 45.21

[56] References Cited

U.S. PATENT DOCUMENTS

| | | | |
|---|---|---|---|
| 1,723,944 | 8/1929 | Marsh | 248/174 |
| 2,563,706 | 8/1951 | Capron et al. | 248/174 X |
| 4,333,622 | 6/1982 | Albano | 248/174 X |
| 4,512,541 | 4/1985 | Lietzke | 248/174 X |
| 4,646,922 | 3/1987 | Smith | 211/132 X |
| 4,723,664 | 2/1988 | Smith | 211/149 |
| 4,877,292 | 10/1989 | Volpe et al. | 248/174 X |
| 5,259,578 | 11/1993 | Jones et al. | 248/174 |

*Primary Examiner*—Alvin C. Chin-Shue
*Assistant Examiner*—Derek J. Berger
*Attorney, Agent, or Firm*—Richard W. Carpenter

[57] ABSTRACT

A collapsible display stand having an article retaining member, including a plurality of vertical panels forming a generally U-shaped structure with an enclosure open at the front, and an article supporting base member, attached to the retaining member in the enclosure and including a plurality of inner support panels. The base member is adapted to move automatically from a collapsed condition to an erected condition when the retaining member is opened.

20 Claims, 3 Drawing Sheets

AUTOMATIC SELF-ERECTING DISPLAY STAND

BACKGROUND OF THE INVENTION

1. Field of the Invention

This invention relates to devices for displaying merchandise, and more particularly to a collapsible paperboard display stand that includes an article retaining member and an article supporting base member, secured to the retaining member, and adapted to move to an erected condition automatically when the retaining member is opened.

2. Description of the Background Art

A background art search directed to the subject matter of this invention conducted in the United States Patent and Trademark Office disclosed the following United States Letters Patent:

| | | |
|---|---|---|
| 2,843,308 | 3,721,413 | 3,738,604 |
| 4,646,922 | 4,723,664 | RE 32,668 |

None of the patents uncovered in the search discloses a collapsible display stand with an article retaining member, including a plurality of vertical panels, and an article supporting base member, attached to the retaining member and including a plurality of inner support panels, and that is adapted to move to an erected condition automatically when the retaining member is opened.

SUMMARY OF THE INVENTION

It is a primary object of the invention to provide an improved display stand with a base that is adapted to move to an erected condition automatically when opened.

Another object of the invention is the provision of a two-piece paperboard display stand.

A more specific object of the invention is to provide a collapsible display stand of the type described that includes an article retaining member, including a plurality of vertical article retaining panels, and an article supporting base member, secured to the retaining member and including a plurality of internal support panels, and that is adapted to move automatically to an erect condition when the retaining member is opened.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
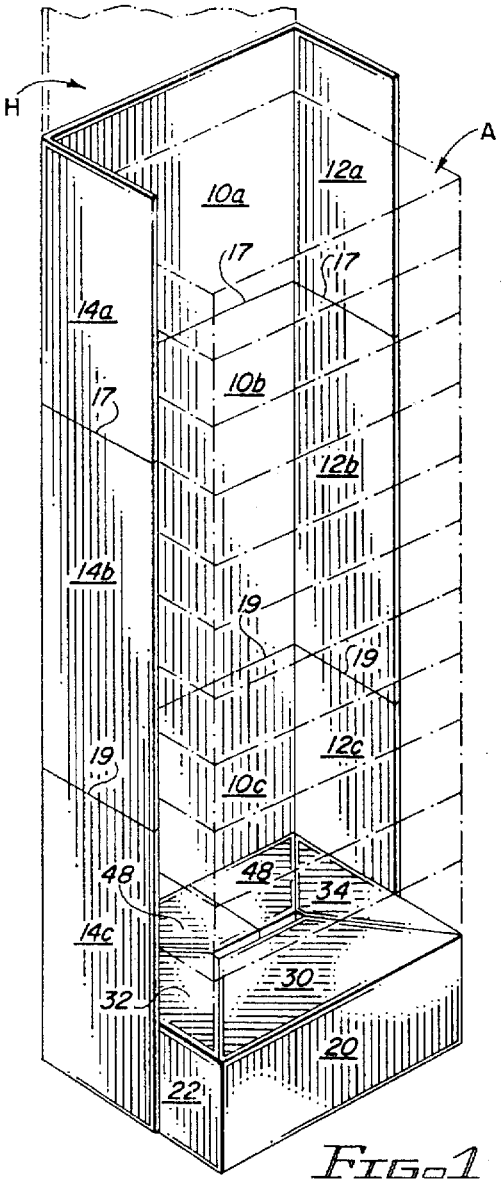
FIG. 1 is an isometric view of a display stand embodying features of the invention, shown in the fully erected condition and filled with articles to be displayed.
Figure 1A:
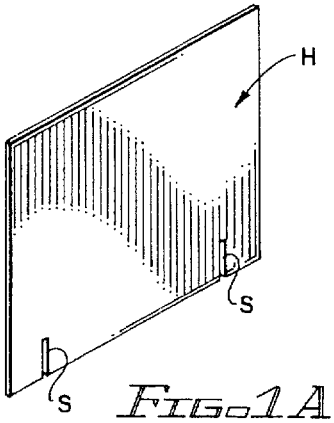
FIG. 1A is an isometric view of a header adapted to be used with the display stand illustrated in FIG. 1.
Figure 2A:
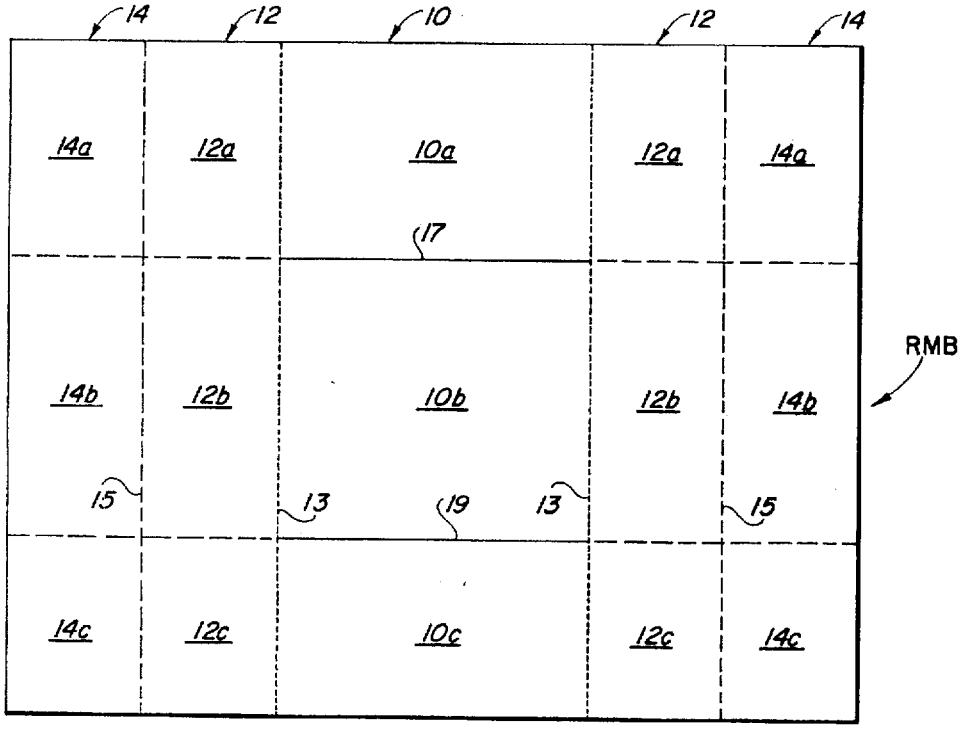
FIG. 2A is a plan view of a blank of foldable sheet material from which the article retaining member of the display stand illustrated in FIG. 1 may be formed.
Figure 2B:
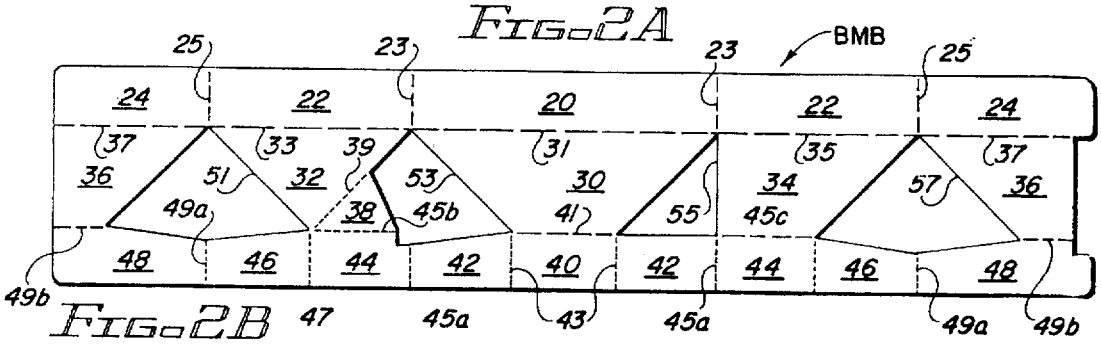
FIG. 2B is a plan view of a blank of foldable sheet material from which the article supporting base member of the display stand illustrated in FIG. 1 may be formed.
Figure 4A:
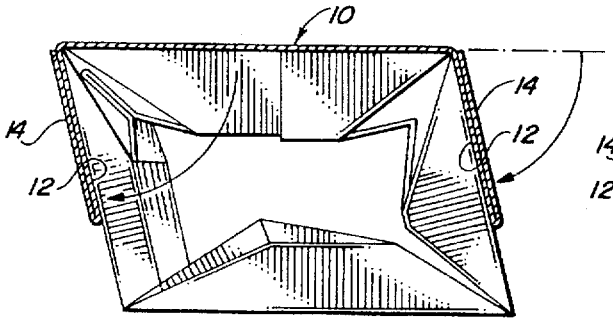
FIGS. 4A and 4B are top plan views showing the self-erecting of the display stand base member.
Figure 4B:
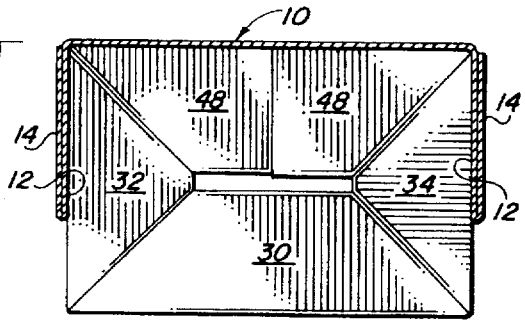

Referring now to the drawings for a better understanding of the invention, it will be seen that the display stand embodying features of the invention, and indicated generally at DS in FIG. 1, comprises a vertically extending, generally U-shaped article retaining member RM and a box-like, article supporting, base member BM, which may be formed from the unitary paperboard blanks RMB and BMB illustrated in FIGS. 2A and 2B, respectively.

As best seen in FIG. 2A, retaining member RM includes a vertical rear panel 10, having a pair of vertical inner end panels 12 foldably joined to opposite side edges thereof along fold lines 13, and a pair of vertical outer end panels 14 foldably joined to side edges of respective inner end panels 12 along fold lines 15.

In order to accommodate collapsibility of the stand, each of the three panels is divided into three panel sections by horizontal fold lines 17 and 19. Panel 10 is divided into sections 10*a*, 10*b*, and 10*c*; Panels 12 are divided into panels 12*a*, 12*b* and 12*c*; and panels 14 are divided into sections 14*a*, 14*b*, and 14*c*. Fold lines 17 and 19 may be scored or perforated to facilitate folding.

As best seen in FIGS. 1 and 2B, article supporting base member BM includes a front side wall panel 20, a pair of end wall panels 22 foldably joined, along fold lines 23, to opposed end edges of front side wall panel 20, and a pair of rear side wall panels 24 foldably joined, along fold lines 25, to rear side edges of respective end wall panels 22.

Figure 4C:
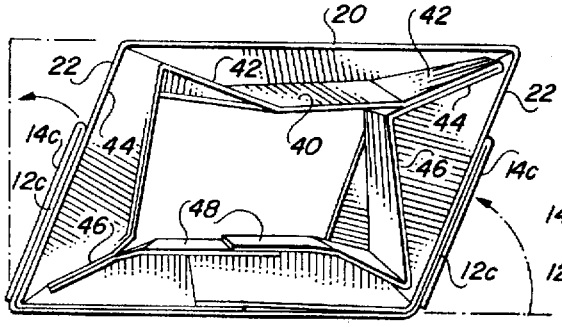
FIGS. 4C and 4D are bottom plan views similar to the views of FIGS. 4A and 4B.
Figure 4D:
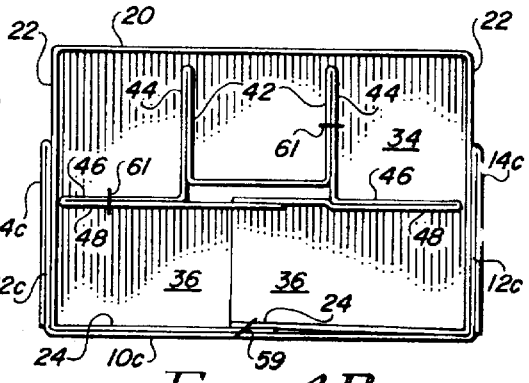

As best seen in FIG. 4D, rear wall panels 24 have overlapped end portions which may be secured to each other by an adhesive or by stapling, as indicated at 59.

Base member BM has a top wall which includes a top wall front side panel 30, foldably joined along fold line 31 to an upper edge of front side wall panel 20; a pair of top wall first and second end panels 32 and 34, foldably joined along fold lines 33 and 35 to upper edges of end wall panels 22; and a pair of co-planer, but separated from each other, top wall rear panels 36, foldably joined along fold lines 37 to upper wedges of rear side wall panels 24.

When the display stand is formed, the base member rear wall panel and/or the base member end wall panels may be attached by adhesive or stapling as desired (not shown in the drawings) to the retaining member rear wall panel 10*c* and/or the retaining member inner end wall panels 12*c*. By having the retaining member so attached to the base member, the base member will self-erect when the retaining member is unfolded, as referred to hereinafter.

An important feature of the display stand of the present invention is the provision of the internal base member supporting structure best seen in FIGS. 2B and 4D.

This structure includes a plurality of narrow support panels, which are all of the same height as the side and end wall panels.

These include: a first support panel 40, foldably joined along fold line 41 to an inboard edge of top wall front side panel 30; a pair of second support panels 42, foldably joined along fold lines 43 to opposed side edges of panel 40; a pair of third support panels 44, foldably joined along fold lines 45*a* to adjacent side edges of respective panels 42; a pair of fourth support panels 46, foldably joined along fold lines 47 to adjacent side edges of respective panels 44; and a pair of fifth support panels 48, foldably joined along fold lines 49*a* to adjacent side edges of respective panels 46. Fold lines 41, 45*a*, 47, and 49*a* are parallel.

One third support panel 44 is also joined, along a fold line 45*b* to one edge of a connecting panel 38, another edge of which is foldably joined, along a fold line 39 to an adjacent edge of top wall first end panel 32. The other support panel 44 is foldably joined to top wall second end panel 34, along a fold line 45*c*.

Fifth support panels 49 are also foldably joined, along fold lines 49*b* to adjacent edges of respective top wall rear side panels 36. Also, as best seen in FIG. 2B, adjacent top wall panels are separated from each other by openings 51, 53, 55, and 57, which extend through the blank BMB and which also separate some of the support panels from some of the top wall panels.

As best seen in FIG. 4D one set of support panels 42 and 44, another set of support panels 46 and 48, and overlapping portions of panels 48 may be secured to each other by stapling, as indicated at 61.

Figure 3A:
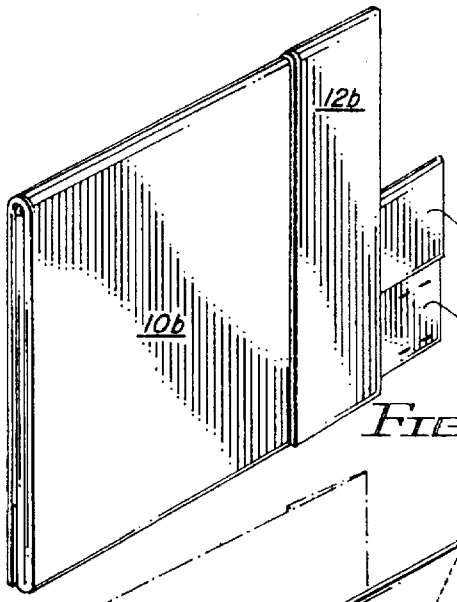
FIG. 3A is an isometric view of the display stand illustrated in FIG. 1, but shown in a collapsed condition.
Figure 3B:
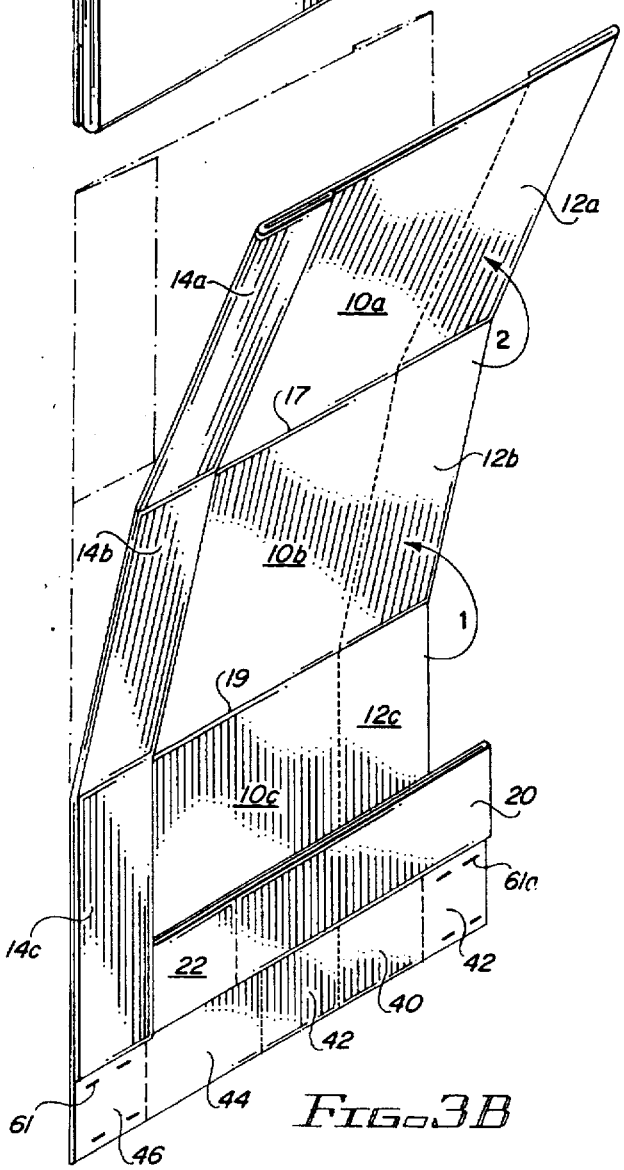
FIGS. 3B–3D are isometric views showing the unfolding of the article retaining member of the display stand and the subsequent automatic self-erecting of the display stand base member.

After the display stand DS has been constructed and the retaining and base members RM and BM have been secured to each, other as previously described herein, the stand may be collapsed for purposes of shipping and storage, as shown in FIG. 3A.

Figure 3C:
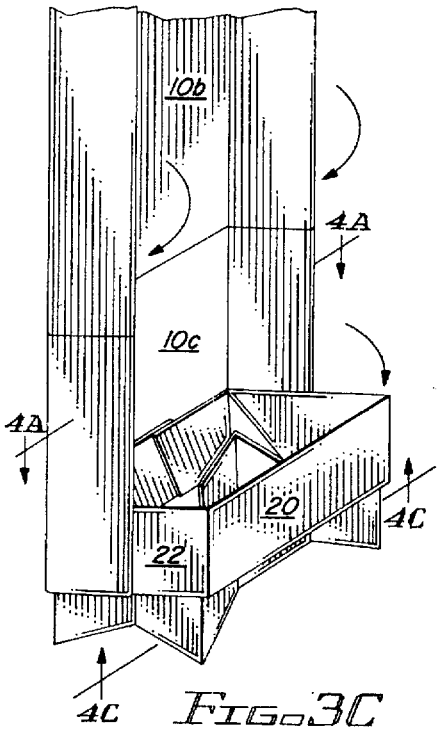
Figure 3D:
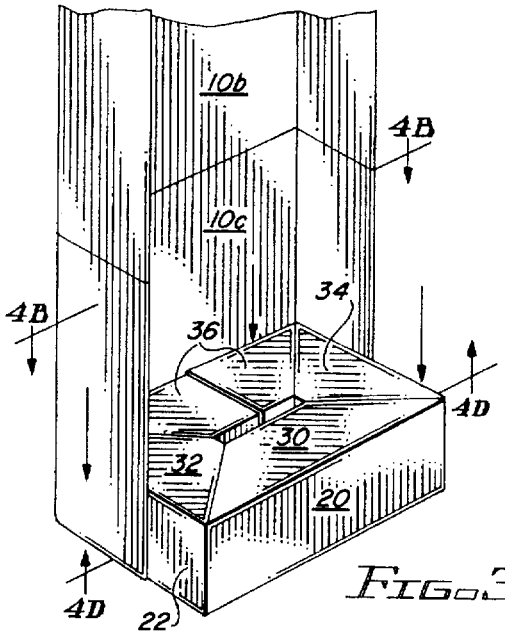

When it is desired to open and erect the stand for use in the display of merchandise, such as the articles shown in FIG. 1, the panels of the retaining member RM are unfolded vertically, as shown in FIG. 3A, and then the panels of the retaining member RM are unfolded laterally or horizontally, as shown in FIGS. 3C and 3D.

As the panels of the retaining member RM are moved to the completely open position, as shown in FIGS. 1 and 3D, the base member BM will automatically self-erect, as shown in FIGS. 3*c* and 4A to 4D.

Not only will the side and end walls of the base member move to erected position, but the support panels will also move to erected position.

It should be understood that the invention provides a strong display stand capable of supporting a plurality of relatively heavy articles of, because of the base supporting structure, and also a display stand that can be collapsed conveniently, for shipping and/or storage, and yet can be erected for use very quickly, because of the self-erecting capability of the base member.

What is claimed is:

1. A collapsible, automatically self-erecting, display stand formed from a pair of blanks of foldable paperboard, comprising;

(a) a vertically extending article retaining member including a rear wall and a pair of end walls extending forwardly therefrom to form a generally U-shaped enclosure open at the front;

(b) an article supporting base member secured to certain of said retaining member walls within said enclosure and being arranged and disposed to self-erect when said retaining member walls are unfolded to an open position;

(c) said base member including;

(i) front and rear side wall panels having corresponding end edges interconnected by a pair of end wall panels;

(ii) a top wall including front and rear top wall panels and a pair of end top wall panels positioned between said front and rear top wall panels;

(d) said base member also having an internal, partition-like, supporting structure, including;

(i) a plurality of vertical, first, support panels, centrally located and extending between said end wall panels;

(ii) a plurality of vertical, second, support panels extending between said first support panels and one of said side wall panels;

(iii) said support panels foldably joined to certain ones of said top wall panels, extending downwardly therefrom, and being co-extensive with said base member side and end wall panels.

2. A display stand according to claim 1, wherein each of said retaining member walls are divided into three vertical sections by a pair of vertically spaced, horizontally extending, fold lines.

3. A display stand according to claim 1, wherein said retaining member end walls each include a pair of inner and outer panels secured to each other in back-to-back relation, and wherein said retaining member end wall inner panels are secured to related end wall panels of said base member.

4. A display stand according to claim 1, wherein certain of said base member support panels are disposed in back-to-back relation with certain other ones of said support panels.

5. A display stand according to claim 1, wherein said base member support panels are free from direct attachment to said base member side and end wall panels, and wherein said transverse support panels extend between said longitudinal support panels and said base member front side wall panel.

6. A display stand according to claim 1, wherein said base member top wall panels are spaced from each other top wall panels.

7. A display stand according to claim 1, wherein certain of said base member longitudinal support panels are aligned with each other, and wherein certain of said base member transverse panels are spaced from each other longitudinally of said base member.

8. A collapsible, automatically self-erecting, display stand formed from a pair of blanks of foldable paperboard, comprising;

(a) a vertically extending article retaining member including a rear wall and a pair of end walls extending forwardly therefrom to form a generally U-shaped enclosure open at the front;

(b) an article supporting base member secured to certain of said retaining member walls within said enclosure and being arranged and disposed to self-erect when said retaining member walls are unfolded to an open position;

(c) said base member including;

(i) front and rear side wall panels having corresponding end edges interconnected by a pair of end wall panels;

(ii) a top wall including front and rear top wall panels and a pair of end top wall panels positioned between said front and rear top wall panels;

(d) said base member also having an internal, partition-like, supporting structure including a plurality of support panels foldably joined to each other, having upper ends foldably joined to certain ones of said top wall panels, extending downwardly therefrom, and being co-extensive with said base member side and end wall panels.

9. A display stand according to claim 8, wherein said support panels include:

(i) a plurality of vertical longitudinal support panels extending between said end wall panels intermediate said side wall panels;

(ii) a plurality of vertical transverse panels extending between said longitudinal panels and one of said side wall panels.

10. A display stand according to claim 9, wherein said base member support panels are free from direct attachment to said base member side and end wall panels, and wherein said transverse support panels extend between said longitudinal support panels and said base member front side wall panel.

11. A display stand according to claim 9, wherein certain of said base member longitudinal support panels are aligned with each other, and wherein certain of said base member transverse panels are spaced from each other longitudinally of said base member.

12. A display stand according to claim 8, wherein each of said retaining member walls are divided into three vertical sections by a pair of vertically spaced, horizontally extending, fold lines.

13. A display stand according to claim 8, wherein said retaining member end walls each include a pair of inner and outer panels secured to each other in back-to-back relation, and wherein said retaining member end wall inner panels are secured to related end wall panels of said base member.

14. A display stand according to claim 8, wherein certain of said base member support panels are disposed in back-to-back relation with certain other ones of said support panels.

15. A display stand according to claim 8, wherein said base member top wall panels are spaced from each other top wall panels.

16. A display stand according to claim 8, wherein said support panels are foldably joined to each other along parallel fold lines.

17. A blank of foldable paperboard, for use in forming an automatically self-erecting, display stand base, said blank being cut and scored to provide:

(a) a front side wall panel;

(b) end wall panels having first side edges foldably joined to opposite end edges of said front wall panel;

(c) rear wall panels having end edges foldably joined to second side edges of said end wall panels;

(d) top wall panels having first edges foldably joined to corresponding edges of adjacent ones of said side and end wall panels;

(e) a plurality of support panels serially arranged and having side edges foldably joined to each other;

(f) certain of said support panels having corresponding other edges foldably joined to adjacent second edges of certain of said ones of said top wall panels.

18. A display stand blank according to claim 17, wherein each of said retaining member walls are divided into three sections by a pair of spaced fold lines extending across said blank.

19. A display stand blank according to claim 17, wherein said base member top wall panels are spaced from each other blank.

20. A display stand blank according to claim 17, wherein said support panels are foldably joined to each other along parallel fold lines.

* * * * *